US007554312B2

(12) United States Patent
Fulton et al.

(10) Patent No.: US 7,554,312 B2
(45) Date of Patent: Jun. 30, 2009

(54) DC-TO-DC VOLTAGE CONVERTER

(75) Inventors: Robert Fulton, Folsom, CA (US); Andrew Volk, Granite Bay, CA (US); Chinnugounder Senthilkumar, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 1525 days.

(21) Appl. No.: 10/609,766

(22) Filed: Jun. 30, 2003

(65) Prior Publication Data

US 2004/0268158 A1 Dec. 30, 2004

(51) Int. Cl.
*G05F 3/16* (2006.01)
*G05F 3/20* (2006.01)

(52) U.S. Cl. ..... 323/315; 323/304; 323/311; 327/538; 327/540; 327/541

(58) Field of Classification Search ..... 323/304, 323/311, 315, 316; 327/538–541
See application file for complete search history.

(56) References Cited

U.S. PATENT DOCUMENTS 4,585,955 A 4/1986 Uchida
5,097,303 A 3/1992 Taguchi
5,973,548 A 10/1999 Ukita et al.
6,100,754 A * 8/2000 Kim et al. ..... 327/541
6,232,805 B1 5/2001 Brandt
6,828,834 B2 * 12/2004 Sivero et al. ..... 327/143
7,002,397 B2 * 2/2006 Kubo et al. ..... 327/534
7,064,601 B2 * 6/2006 Kwak et al. ..... 327/541

FOREIGN PATENT DOCUMENTS

JP 2002112457 A * 4/2002

OTHER PUBLICATIONS

Lai, J.S., Levy, S., & Rose, M.F. (Apr. 1992). High energy density double-layer capacitors for energy storage applications. Aerospace and Electronic Systems Magazine, IEEE, vol. 7, Issue 4, pp. 14-19.*
U.S. Appl. No. 10/609,513, Office Action Mailed Sep. 1, 2004 for 42P16329.
U.S. Appl. No. 10/609,513, Notice of Allowance Mailed Mar. 3, 2005 for 42P16329.

* cited by examiner

*Primary Examiner*—Kiesha L Rose
*Assistant Examiner*—Fred E Finch, III
(74) *Attorney, Agent, or Firm*—Blakely, Sokoloff, Taylor & Zafman LLP

(57) ABSTRACT

According to an embodiment of the invention, a method and apparatus for DC voltage conversion are described. According to one embodiment, a voltage converter comprises a current mirror, the current mirror being coupled with a power source; a first transistor device coupled with a bias generator to receive a bias voltage; a second transistor device coupled between the current mirror and the first transistor device; and an output transistor device, a gate of the output transistor device being coupled with a gate of the second transistor device and to the current mirror.

18 Claims, 4 Drawing Sheets

DC-TO-DC VOLTAGE CONVERTER

FIELD

An embodiment of the invention relates to electronic circuits in general, and more specifically to a DC-to-DC voltage converter.

BACKGROUND

In certain electronic circuits, a converted voltage may be used. For example, in a modern PC (personal computer) system, a real time clock (RTC) produces a frequency output that is then used to provide a time base for the system, which thus requires constant power. For this purpose, an RTC Crystal Oscillator (RTCCO) resides on an I/O (input/output) controller hub chip, which is sometimes referred to as the "southbridge". An RTC circuit provides an accurate oscillator output (commonly a frequency of 32.768 kHz) that is used as the main clock to maintain system time. The output of the RTC circuit is divided to obtain time in units of seconds, minutes, and hours. The time is stored by the system and used as the time basis for the system, which is maintained when the system power is either on or off.

When PC system is powered down, the RTC circuit derives power from another power source, such as a self-contained source in the PC. A 3.0-volt coin cell lithium battery is generally used because such batteries are widely available and very inexpensive. In certain systems, another power source, such as a charged capacitor, may provide the power for the RTC circuit when the system is powered down. A PC system may be turned off for long periods of time, possibly for years, depending upon usage and the length of time a system may stay in storage. Therefore, an RTC circuit may potentially need to derive power from a coin cell battery or other such power source for a period of years to maintain system time.

As computer processes move towards lower voltages in order to reduce power consumption and to increase speed in digital sections, the voltage of a coin cell may need to be stepped down to a lower voltage, such as a voltage range of less than 2 volts, depending upon the process voltage. The process of converting a DC voltage to a lower voltage consumes some amount of power, thereby reducing the length of time that the system can maintain the system time. Further, a certain minimum voltage is needed to operate the supplied circuit. Because the voltage of a battery or capacitor power source will fall over time as power is consumed, the voltage response of the DC-to-DC converter has an impact on the operation of the supplied circuit.

FIG. 1 illustrates one example of a conventional DC-to-DC converter. A voltage supply 105, such as a coin battery, provides a voltage to the circuit. The voltage supply is connected to the source of circuit is comprised of diode-connected transistors $Q_2$ 110 and $Q_3$ 115, which provide voltage drops and step down the voltage to the gate of output device 135. A reference load is provided, shown in FIG. 1 as comprising diode-connected transistors $Q_4$ 120 and $Q_5$ 125. Connected between $Q_4$ 120 and $Q_5$ 125 is transistor device $Q_1$ 130. A current through $Q_1$ 130 to adjust the reference load is provided by a clamping control circuit 160, which is controlled by a signal 165. The output voltage 140 from the circuit is supplied to certain devices, shown as an RTC oscillator 145 and RTC logic 150 utilized in maintenance of system time.

FIG. 2 is a graph of voltage output for a conventional DC-to DC converter, such as that shown in FIG. 1. The graph is provided for illustration and is not necessarily drawn to scale. FIG. 2 shows $V_{in}$ 205 on the X-axis versus $V_{out}$ 210 on the Y-axis for various voltages. $V_{in}$ 205 is the voltage supplied by the power source, such as a battery or capacitor. $V_{out}$ is the voltage output provided by the converter. A value for $V_s$ 215 is shown on the Y-axis, $V_s$ being the supply voltage required for operation of the devices that receive the output voltage. The graph curve 220 for $V_{in}$ versus $V_{out}$ falls off relatively quickly as the value of $V_{in}$ drops. Therefore, the output voltage will drop off as a battery or other power source is depleted, eventually dropping below the needed voltage for operation of supplied devices, such as an RTC circuit.

BRIEF DESCRIPTION OF THE DRAWINGS

The invention may be best understood by referring to the following description and accompanying drawings that are used to illustrate embodiments of the invention. In the drawings.

DETAILED DESCRIPTION

Figure 1:
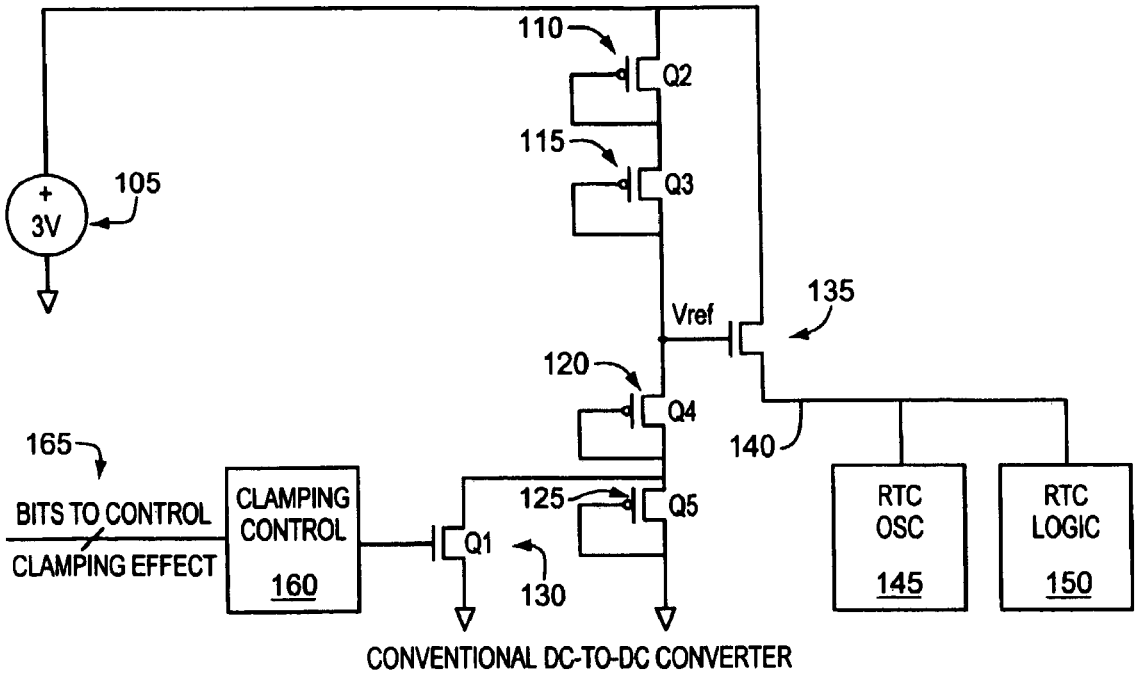
FIG. 1 Prior Art
FIG. 1 illustrates an example of a conventional DC-to-DC converter.
Figure 2:
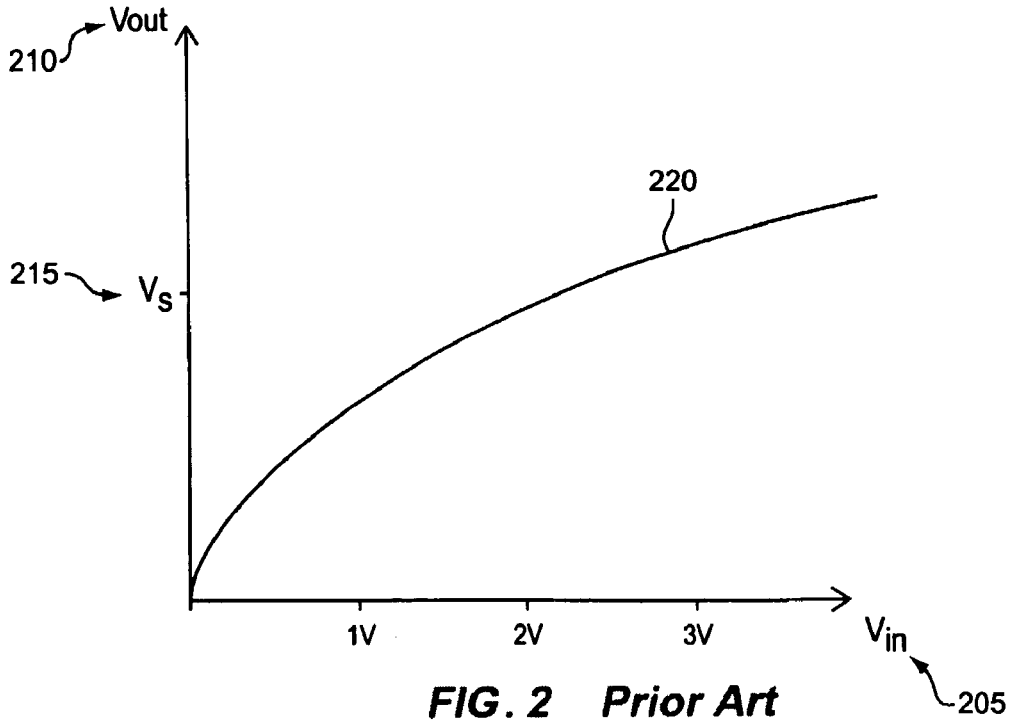
FIG. 2 Prior Art
FIG. 2 is a graph of voltage response of a conventional DC-to-DC converter.

A method and apparatus are described for a low power DC-to DC converter.

DC-to-DC Converter

According to an embodiment of the invention, a simplified DC-to-DC converter based on linear regulation is implemented. The simplicity of the DC-to-DC converter can provide for reduced current draw and less complicated circuitry, as compared to sophisticated voltage regulators. Sophisticated voltage regulators, though often providing good voltage regulation, may draw significant amounts of current and involve complicated circuitry, including feedback arrangements.

Under an embodiment of the invention, a DC-to-DC converter can provides for a relatively flat voltage response, providing a stable reference voltage for a wide variety of supply voltages. For this reason, an output from the converter output may not vary greatly as input voltage drops. In one example, a power source, such as a battery, provides a voltage that drops over a period of time. The voltage provided by the power source is converted by a DC-to-DC converter and utilized as a source voltage for a circuit, such as an RTC circuit maintaining a system time. Using an embodiment of the invention, the voltage level provided to the circuit is maintained at a relatively constant level as the voltage of the power source drops over a period of time, until the voltage reaches a minimum level. By maintaining the voltage level, the system may allow extended operation of the circuit. When the power source has a higher voltage (such as with a new battery), a circuit will generally consume more power than is necessary. When the power source has a lower voltage (such as with an older battery), the circuit may not receive a sufficiently high voltage to operate properly.

Under an embodiment of the invention, the provision of a relatively constant voltage output may simplify design of the circuit that receives the voltage. If a voltage source provides a relatively wide range of voltages, then a circuit, such as an RTC circuit, must accommodate the power supply swing as voltages change. If a voltage source provides a narrower range of voltages, then the circuit is not required to accommodate as wide of a power supply swing.

According to an embodiment of the invention, a DC-to-DC converter utilizes a bias voltage that is provided by another circuit. The use of the bias voltage provides for process, voltage and temperature (PVT) compensation for the output voltage. The DC-to-DC converter can dynamically provide a minimum required output voltage for a wide range of process and temperature conditions. Under an embodiment of the invention, the circuit may also allow an option for tuning the output voltage of DC-to-DC converter in post-silicon (after fabrication) state by use of configurable register settings that are based on post-silicon performance.

According to an embodiment of the invention, a DC-to-DC converter provides a voltage with minimal current draw. With the use of the converter, the life of a power source can be extended. In one illustration, the average useful life of a lithium coin cell battery life supplying an RTC circuit may be extended by 15% as compared to conventional operation. The extended lifetime allows for continued use of coin cell batteries or similar devices in computer operation, and reduces maintenance connected with battery replacement. If a charged capacitor is utilized in a personal computer in lieu of a coin cell battery (as is common in, for example, personal computers operated in Europe) the linear discharge of the capacitor results in a significant extension of operation. In certain circumstances, the allowable discharge time may be increased by 100% as compared to conventional operations.

An embodiment of a DC-to-DC converter may leverage a known reference load to bias the output voltage to a level that is very near the minimum voltage required. The maintenance of voltage at this level helps to compensate for PVT variation. Further, the circuit accomplishes this purpose while consuming small amounts of current, which may be in the range of only a few hundred nano-Amps of current. In one example, the DC-to-DC converter may provides a reference voltage while consuming less than 0.5 μA of current consumption, or under 1.5 μWatts of power consumption.

Figure 3:
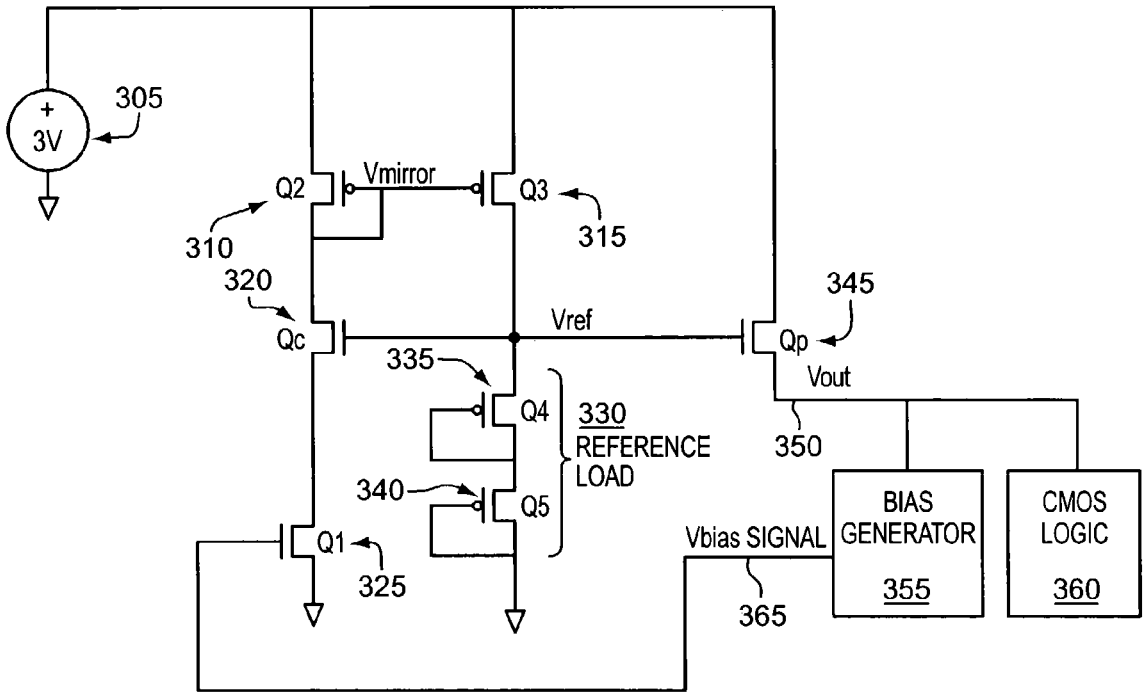
FIG. 3 illustrates an embodiment of a DC-to-DC converter.

FIG. 3 contains a block diagram of an embodiment of a DC-to-DC converter. The CMOS logic block 360 contains the supplied circuits that are powered by the DC-to-DC converter output. The bias generator block 355 includes a circuit to generate a bias voltage for the DC-to-DC converter. In one embodiment, the bias generator consists of a constant-GM network utilized in an oscillator. Embodiments of the invention can be implemented in many other types of circuits, with the bias generation circuit being provided as appropriate.

In the illustration shown in FIG. 3, a current is generated through a transistor device $Q_1$ 325 based on the voltage level of a $V_{bias}$ signal 365 that is applied to the gate terminal of $Q_1$ 325. The $V_{bias}$ signal 365 is generated by a bias generator circuit 355. The bias generator circuit may vary and is not limited to any particular design. The current through $Q_1$, $I_{Q1}$, passes through a cascode device $Q_c$ 320 and is pulled through a transistor device $Q_2$ 310. $Q_2$ 310 is configured in a diode-connected manner, and is connected to a transistor device $Q_3$ 315 in a current mirror configuration. The gates and sources of $Q_2$ 310 and $Q_3$ 315 are tied together, and therefore, assuming saturation mode of operation, the current densities of the two devices will match. A voltage $V_{mirror}$ is generated at the gates of the devices, the voltage level being based on the relationship of the drain current to drain-source voltage ($I_d/V_{ds}$) relationship for a particular $Q_2$ device.

The current generated by the $Q_2$-$Q_3$ current mirror through $Q_3$ 315, $I_{Q3}$, is passed through a reference load. The reference load may vary depending on the characteristics needed, as described more fully below. In the illustration shown in FIG. 3, the reference load 330 comprises transistor devices $Q_4$ 335 and $Q_5$ 340. Devices $Q_4$ 335 and $Q_5$ 340 are arranged in a diode-connected configuration, and, for a given $I_{Q3}$, a voltage $V_{ref}$ will be proportional to the sum of the devices' I/V (current to voltage) relationships. The voltage $V_{ref}$ is applied to the gate of output transistor device $Q_p$ 345. For a given device size and for a given range of power well current draw, the operating range $V_{gs}$ of $Q_p$ 345 can be determined. Thus, for a given $V_{ref}$ value applied to the gate of $Q_p$ 345, the range of an output voltage $V_{out}$ 350 can be determined as well. The output voltage can be determined based on device characteristics, the value of $V_{ref}$, and the power well current draw from the output, $I_{Qp}$, as follows:

$$V_{out} \cong V_{ref} - K_1 \cdot \sqrt{I_{Qp}} \quad (1)$$

Where $K_1$ is a constant that is dependent on the characteristics of device $Q_p$ and on the magnitude of the total current draw.

In a particular embodiment of the invention, various circuit relationships and factors affect the voltage level of $V_{ref}$ and therefore affect the output voltage. In the design of a voltage converter for a particular implementation, these elements may be adjusted to provide a desired output. The elements include the device size and type of the elements of the reference load, such as load devices $Q_4$ 335 and $Q_5$ 340; the size and device type of $Q_1$ 325; the $V_{bias}$ 365 voltage level, which is affected by the choice of bias generator 355; and the device size ratio of the current mirror devices $Q_2$ 310 and $Q_3$ 315.

The output $V_{out}$ then is applied to the bias generator 355 and to any supplied devices. In the example shown in FIG. 3, the supplied devices are shown as CMOS logic 360. In one example, the logic 360 may comprise a real time clock circuit that maintains the system time for a computer when normal power for the computer is turned off.

Figure 4:
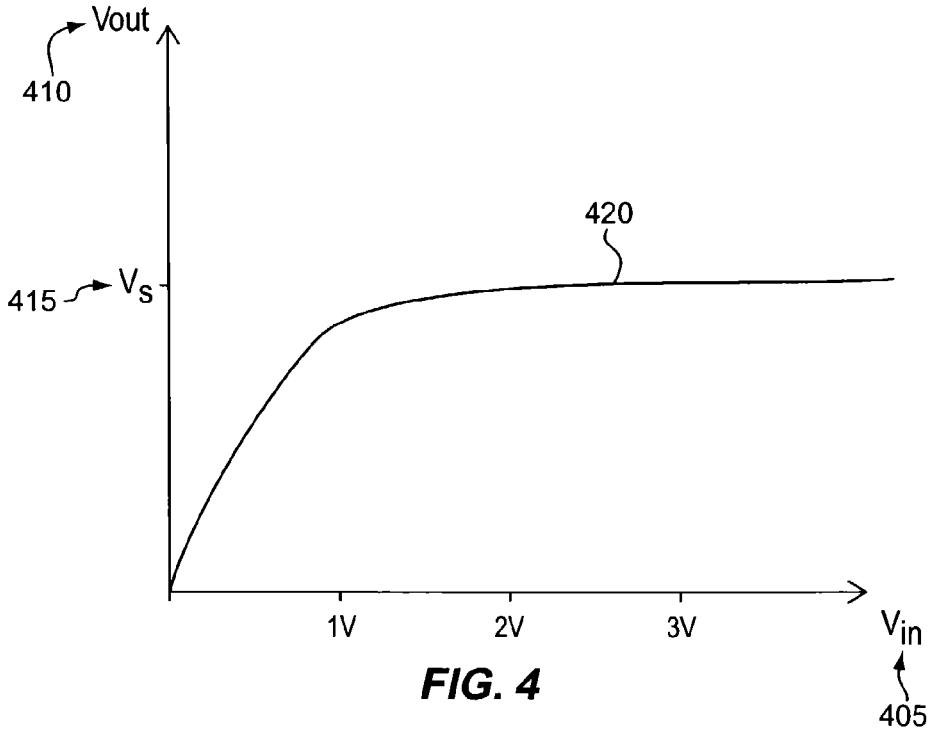
FIG. 4 is a graph of voltage response of an embodiment of a DC-to-DC converter.

FIG. 4 is a graph illustrating the relationship between input voltage and output voltage for an embodiment of the invention. The graph is provided for illustration and is not necessarily drawn to scale. FIG. 4 shows $V_{in}$ 405 on the X-axis versus $V_{out}$ 410 on the Y-axis for various voltages. $V_{in}$ 405 is the voltage supplied by the power source, such as a battery or capacitor. $V_{out}$ is the voltage output provided by the converter. A value for $V_s$ 415 is shown on the Y-axis, $V_s$ being the supply voltage required for operation of the devices that receive the output voltage. The graph curve 420 for $V_{in}$ versus $V_{out}$ remains relatively flat within a particular operating range as $V_{in}$ varies, thereby indicating that a stable reference voltage is available for a wide variety of supply voltages. Therefore, the output voltage will remain relatively constant as a battery or other power source is depleted, allowing extended operation of supplied devices, such as an RTC circuit.

Bias Generator

Figure 5:
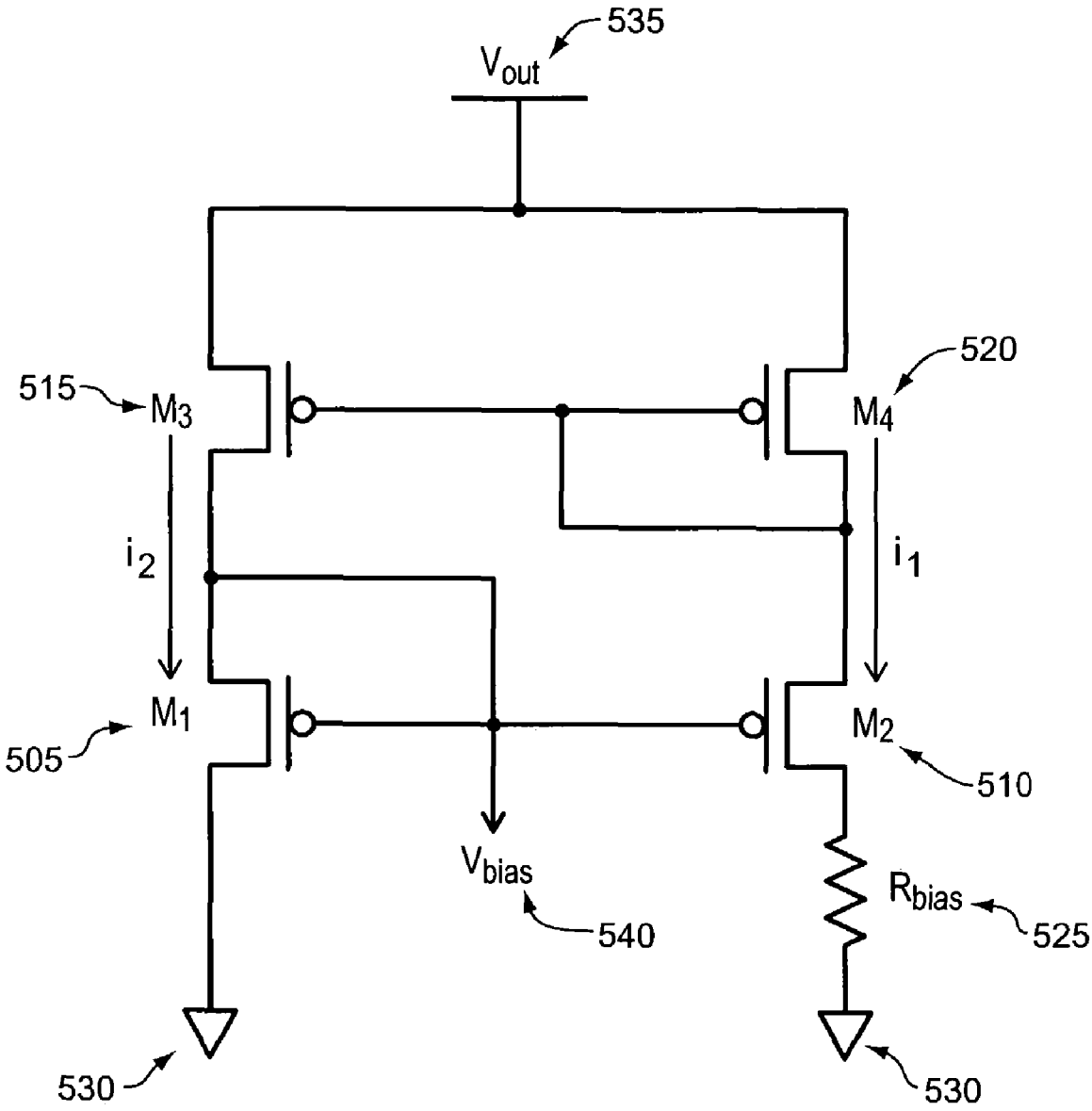
FIG. 5 is an illustration of a bias generation circuit utilized in conjunction with an embodiment of the invention.

FIG. 5 is an illustration of a circuit providing a bias voltage for an embodiment of the invention. The circuit shown in FIG. 5 is only an example of a circuit that provides a bias voltage and many other types of circuits may be utilized in conjunction with an embodiment of the invention. The illustrated circuit is a constant-GM (transconductance) bias circuit. The circuit is based on weak inversion operation, and generates a constant reference current.

The bias generation circuit receives a supply voltage, which is shown as $V_{out}$ 535, such as the output of a DC-to-DC voltage generator under and embodiment of the invention. The bias generation circuit comprises four transistor devices, $M_1$ 505, $M_2$ 510, $M_3$ 515 and $M_4$ 520, and a bias resistor, $R_{bias}$ 525. The gates of $M_1$ 505 and $M_2$ 510 are connected together, with the gate and source of $M_1$ 505 being tied together. The gates of $M_3$ 515 and $M_4$ 520 are connected together, with the gate and drain of $M_4$ 520 being tied together. Bias resistor $R_{bias}$ 525. is connected between the drain of $M_2$ 510 and ground 530. The constant reference current $i_1$ may be determined as:

$$i_1 = \frac{V_T}{R_{BIAS} \cdot \ln(m \cdot k)} \quad (2)$$

Where:

$V_T$ = Thermal voltage, approximately 26.5 mV@300 K $R_{BIAS}$ = resistance of biasing resistor $$m = \frac{\beta_3}{\beta_1}$$

$$k = \frac{\beta_2}{\beta_4} \text{ (with } \beta_n \text{ being the } \beta \text{ value for each } M_n \text{ device)}$$

The voltage produced at the gates of $M_1$ 505 and $M_2$ 510 is $V_{bias}$ 540, which may be used as the bias voltage in an embodiment of the invention.

Reference Load Devices

Under an embodiment of the invention, many different reference load devices may be utilized in a DC-to-DC converter. The choice of a reference load device can have a significant impact on circuit operation. As shown in FIG. 3, one possible reference load comprise of two high-$V_t$ devices.

The load being powered by a DC-to-DC converter will draw a certain range of current at a given voltage. In a certain implementation, a DC-to-DC converter circuit powers CMOS logic elements in an ultra-low power state, with a few micro-amps of current being consumed per 10 k gates. In order to minimize excess leakage current, a voltage is supplied that is sufficiently high to allow the logic to operate correctly, but is low enough to prevent unnecessary power consumption.

In one example, an absolute minimum voltage to be supplied for all allowable process variation and temperature range may be chosen. If an absolute minimum voltage level is chosen, the reference load devices could comprise a low tolerance resistor. A minimum value for $V_{ref}$ applied to the output transistor can be found based upon the maximum power well current draw and using equation (1) or a more precise version of this calculation. With this minimum value, corresponding values for the resistor load and minimum $I_{Q3}$ can be designed or chosen. A disadvantage to choosing a constant reference load is that the excess voltage margin (the amount of headroom above low-$V_{CC}$ inducted failing point) may be low in the worst case process/temperature analysis, and be excessive in the opposite best case process/temperature analysis.

Other reference loads can be chosen for different applications of embodiments of a converter circuit. Elements affecting the choice of reference loads include the allowable current draw of the circuit, the required accuracy of the $V_{out}$ supply, and the desired process/temperature compensation, if any. For example, if a $V_{bias}$ signal from a bias generation circuit is relatively constant (such a signal from a band gap or similar circuit), and the $V_{out}$ voltage is thus relatively independent of process, voltage, and temperature variation, then a precision resistance load may be a desirable reference load. In an application in which a portable device is running using the power from a battery, the digital logic requires sufficient power, although not to a wasteful level. The choice of reference loads in this case may be a sample piece of logic which is connected in a manner to draws a reference based the device's own required switching current. For a given switching current, the required voltage needed is generally less for devices with low thermal energy than devices with high thermal energy. Therefore, passing a desired quantity of switching current through a circuit that is representative of the logic may save power by reducing an excessive voltage margin. In designing target levels for output voltage, system noise and transistor device may account for some of the required voltage margin that will be needed.

In some applications, logic being powered by a DC-to-DC converter may have a low power state (sleep state) and a high power state (active state). According to an embodiment of the invention, logic may be powered by a battery or similar power source in a sleep state, and by a standard power source (such as power from a wall outlet) in the active state. For CMOS logic, the power consumed is proportional to the voltage levels being applied. A reduction in the voltage level applied in the sleep state thus can reduce power consumption. While the voltage reference generator may vary and is not limited to any particular design, the voltage reference generator may include an adjustable voltage reference generator described in U.S. patent application Ser. No. 10/609,513, issued as U.S. Pat. No. 6,924,692.

Startup Circuit for DC-to-DC Converter

During startup conditions, a power supply, such as a 3V supply in a computer, is ramped up to the output voltage, and the output voltage is initially at ground or floating potential. While a bias voltage generator circuit is not properly powered, a bias voltage also generally will be at ground or floating potential. In the illustration provided in FIG. 3, unless a startup circuit is applied, the current through the $Q_2$ 310 leg (and therefore also through the mirrored $Q_3$ 315 leg) would be zero. This condition re-enforces the output supply voltage at ground potential, thus resulting in a startup failure. To overcome the initial state, the bias generation circuit generally requires application of sufficient power until the bias circuit has sufficiently started and has reached operating bias voltage levels. Once the circuit has started and the bias voltage reaches sufficient bias levels, the startup mechanism is no longer needed and can be eliminated to prevent any additional current draw. While startup circuits or mechanisms utilized in conjunction with an embodiment of the invention may vary and are not limited to any particular design, a startup circuit that may be utilized is a startup circuit described in U.S. patent application Ser. No. 10/331,390, issued as U.S. Pat. No. 7,157,894.

ALTERNATIVE EMBODIMENTS

Figure 6:
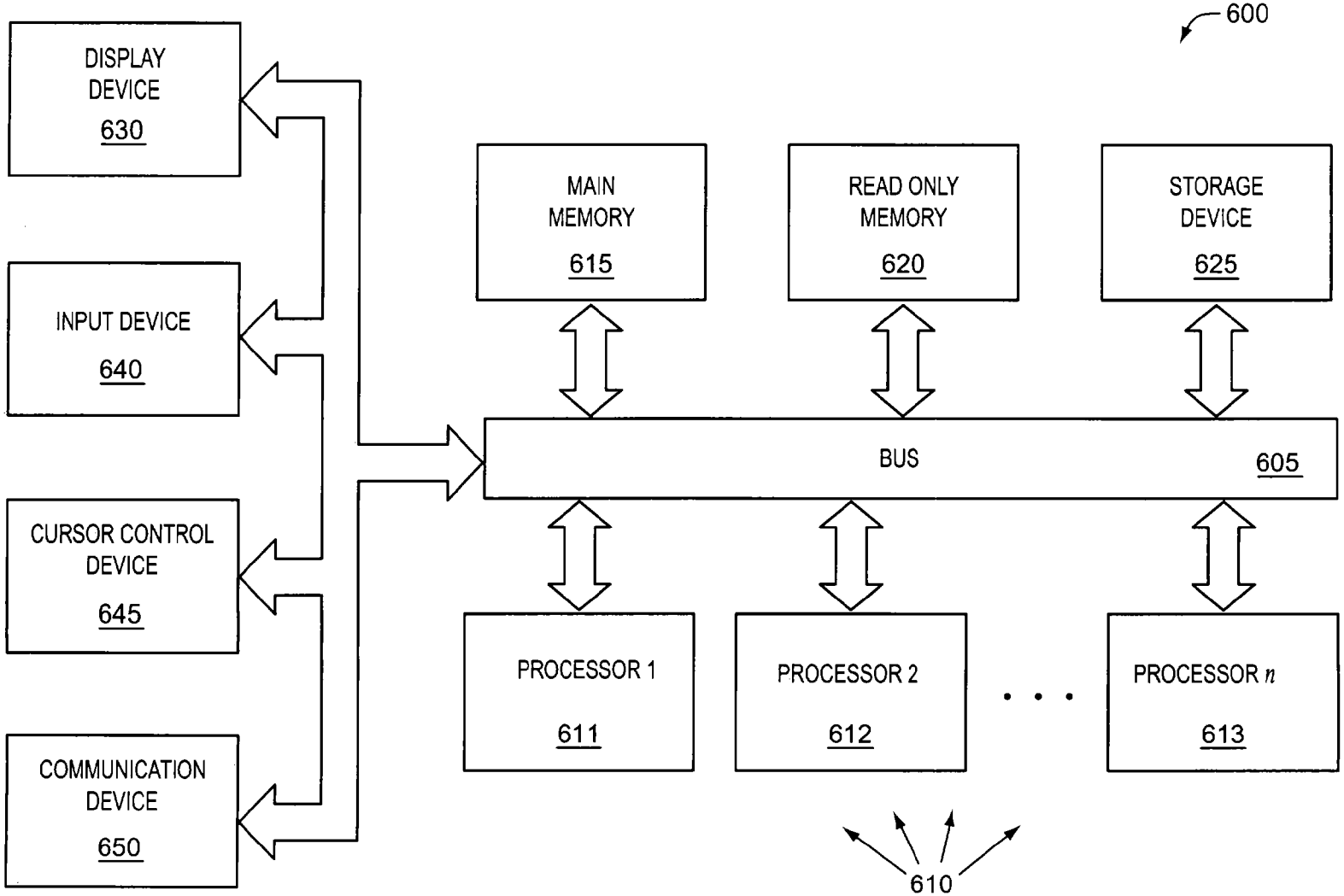
FIG. 6 illustrates an embodiment of a computer system.

Techniques described here may be used in many different environments. One possible environment is a computer with a backup power supply that is used to maintain the system clock. FIG. 6 is block diagram of an exemplary computer that can be used in conjunction with an embodiment of the invention. Under an embodiment of the invention, a computer 600 contains a power source, such as a battery or capacitor, to operate a real time clock that maintains the system time for the computer when the power for the system is turned off or is otherwise unavailable.

Under an embodiment of the invention, a computer 600 comprises a bus 605 or other communication means for communicating information, and a processing means such as one or more processors 610 (shown as 611, 612 and continuing through 613) coupled with the bus 605 for processing information. The maintained system time may be utilized by the processors 610 in normal system operations.

The computer 600 further comprises a random access memory (RAM) or other dynamic storage device as a main memory 615 for storing information and instructions to be executed by the processors 610. Main memory 615 also may be used for storing temporary variables or other intermediate information during execution of instructions by the processors 610. The computer 600 also may comprise a read only memory (ROM) 620 and/or other static storage device for storing static information and instructions for the processor 610.

A data storage device 625 may also be coupled with the bus 605 of the computer 600 for storing information and instructions. The data storage device 625 may include a magnetic disk or optical disc and its corresponding drive, flash memory or other nonvolatile memory, or other memory deviceSuch elements may be combined together or may be separate components, and utilize parts of other elements of the computer 600.

The computer 600 may also be coupled via the bus 605 to a display device 630, such as a liquid crystal display (LCD) or other display technology, for displaying information to an end user. In some environments, the display device may be a touch-screen that is also utilized as at least a part of an input device. In some environments, display device 630 may be or may include an auditory device, such as a speaker for providing auditory information. An input device 640 may be coupled with the bus 605 for communicating information and/or command selections to the processor 610. In various implementations, input device 640 may be a keyboard, a keypad, a touch-screen and stylus, a voice-activated system, or other input device, or combinations of such devices. Another type of user input device that may be included is a cursor control device 645, such as a mouse, a trackball, or cursor direction keys for communicating direction information and command selections to processor 610 and for controlling cursor movement on display device 630.

A communication device 650 may also be coupled with the bus 605. Depending upon the particular implementation, the communication device 650 may include a transceiver, a wireless modern, a network interface card, or other interface device. The computer 600 may be linked to a network or to other devices using the communication device 650, which may include links to the Internet, a local area network, or another environment.

General Matters

In the description above, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form.

The present invention includes various steps. The steps of the present invention may be performed by hardware components or may be embodied in machine-executable instructions, which may be used to cause a general-purpose or special-purpose processor or logic circuits programmed with the instructions to perform the steps. Alternatively, the steps may be performed by a combination of hardware and software.

Portions of the present invention may be provided as a computer program product, which may include a machine-readable medium having stored thereon instructions, which may be used to program a computer (or other electronic devices) to perform a process according to the present invention. The machine-readable medium may include, but is not limited to, floppy diskettes, optical disks, CD-ROMs, and magneto-optical disks, ROMs, RAMs, EPROMs, EEPROMs, magnet or optical cards, flash memory, or other type of media/machine-readable medium suitable for storing electronic instructions. Moreover, the present invention may also be downloaded as a computer program product, wherein the program may be transferred from a remote computer to a requesting computer by way of data signals embodied in a carrier wave or other propagation medium via a communication link (e.g., a modern or network connection).

Many of the methods are described in their most basic form, but steps can be added to or deleted from any of the methods and information can be added or subtracted from any of the described messages without departing from the basic scope of the present invention. It will be apparent to those skilled in the art that many further modifications and adaptations can be made. The particular embodiments are not provided to limit the invention but to illustrate it. The scope of the present invention is not to be determined by the specific examples provided above but only by the claims below.

It should also be appreciated that reference throughout this specification to "one embodiment" or "an embodiment" means that a particular feature may be included in the practice of the invention. Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims are hereby expressly incorporated into this description, with each claim standing on its own as a separate embodiment of this invention.

What is claimed is:

1. A voltage converter comprising:

a current mirror to be coupled with a power source;

a first transistor device to be coupled with a bias generator to receive a bias voltage, the first transistor device generating a first current;

a second transistor device coupled between the current mirror and the first transistor device, the first current generated by the first transistor device to pass through the second transistor device to pull the first current through the current mirror;

a reference load coupled with the gate of the second transistor device and the current mirror, the reference load to receive a second current generated by the current mirror to produce a reference voltage; and an output transistor device, a gate of the output transistor device being coupled with a gate of the second transistor device, the reference load, and the current mirror, the output transistor device to receive the reference voltage and to produce a converted voltage, the converted voltage being supplied to the bias generator and to logic elements, the logic elements comprising a real time clock (RTC) circuit.

2. The voltage converter of claim 1, wherein the reference load comprises one or more diode-connected transistor devices.

3. The voltage converter of claim 1, wherein the current mirror comprises a third transistor device and a fourth transistor device, a gate of the third transistor device being coupled with a gate of the fourth transistor device.

4. The voltage converter of claim 1, wherein the power source comprises a battery.

5. The voltage converter of claim 1, wherein the power source comprises a charged capacitor.

6. A method comprising:

receiving a direct current input voltage from a power source;

receiving a bias voltage from a bias generator circuit; and producing a converted voltage based at least in part on the input voltage and the bias voltage;

wherein the converted voltage is supplied to the bias generator circuit and to logic elements, the logic elements comprising a real time clock (RTC) circuit.

7. The method of claim 6, further comprising mirroring a first current to produce a second current.

8. The method of claim 7, wherein the first current is directed through a transistor device that receives the input voltage.

9. The method of claim 7, further comprising providing the second current to a reference load.

10. The method of claim 9, wherein the reference load comprises one or more diode-connected transistor devices.

11. The method of claim 6, wherein the bias generator circuit comprises a constant-GM (transconductance) source.

12. A computer comprising:

a processor;

a real time clock, the real time clock maintaining a system time utilized by the processor;

a bias generator;

a power source to supply power for the real time clock and the bias generator; and a DC-to-DC voltage converter to convert a voltage supplied by the power source to a voltage utilized by the real time clock and the bias generator, the DC-to-DC voltage converter comprising:

a current mirror coupled with the power source;

a first transistor device coupled with the bias generator to receive a bias voltage and generate a first current;

a second transistor device coupled between the current mirror and the first transistor device, the first current generated by the first transistor device to pass through the second transistor device to pull the first current through the current mirror;

a reference load coupled with the gate of the second transistor device and the current mirror, the reference load to receive a second current generated by the current mirror to produce a reference voltage; and an output transistor device, a gate of the output transistor device being coupled with a gate of the second transistor device, the reference load and the current mirror, the output transistor device to receive the reference voltage and to produce a converted voltage, the converted voltage being supplied to the bias generator and to logic elements, the logic elements comprising a real time clock (RTC) circuit.

13. The computer of claim 12, wherein the reference load comprises one or more diode-connected transistor devices.

14. The computer of claim 12, wherein the current mirror comprises a third transistor device and a fourth transistor device, a gate of the third transistor device being coupled with a gate of the fourth transistor device.

15. The computer of claim 12, wherein the power source is a power source that is utilized when the computer is turned off.

16. The computer of claim 15, wherein the power source comprises a battery.

17. The computer of claim 15, wherein the power source comprises a charged capacitor.

18. The computer of claim 12, wherein the bias generator comprises a constant-GM (transconductance) circuit.

* * * * *